US006030281A

United States Patent [19]

Cozzini et al.

[11] Patent Number: 6,030,281

[45] Date of Patent: Feb. 29, 2000

[54] SHARPENING APPARATUS

[75] Inventors: Ivo Cozzini, Lincolnwood; Thomas Spino, Gurnee, both of Ill.

[73] Assignee: Cozzini, Inc., Chicago, Ill.

[21] Appl. No.: 09/149,959

[22] Filed: Sep. 9, 1998

Related U.S. Application Data

[60] Provisional application No. 60/058,340, Sep. 10, 1997.

[51] Int. Cl.[7] ..... B24B 25/00

[52] U.S. Cl. ..... 451/320; 451/321; 451/312; 451/371; 451/4.5

[58] Field of Search ..... 451/45, 164, 166, 451/170, 312, 319, 320, 321, 322, 364, 365, 367, 368, 377, 378, 392, 393, 404, 409, 555, 556, 557, 371

[56] References Cited

U.S. PATENT DOCUMENTS

| | | | |
|---|---|---|---|
| 471,679 | 3/1892 | Spruce | 451/321 |
| 480,634 | 8/1892 | Spruce . | |
| 1,371,947 | 3/1921 | Stratton | 451/320 |
| 1,628,754 | 5/1927 | Strand . | |
| 1,675,981 | 7/1928 | Lees | 451/320 |
| 1,770,538 | 7/1930 | Warner | 451/321 |
| 2,131,626 | 9/1938 | Keith . | |
| 2,278,553 | 4/1942 | Morrow . | |
| 2,458,257 | 1/1949 | Donovan | 451/321 |
| 2,864,206 | 12/1958 | Lane et al. | 451/320 |
| 3,812,740 | 5/1974 | Gilliland . | |
| 3,882,642 | 5/1975 | Sykes | 451/320 |
| 4,217,735 | 8/1980 | McGeoch et al. . | |
| 4,510,824 | 4/1985 | Byers . | |
| 4,512,111 | 4/1985 | Childers . | |
| 4,807,399 | 2/1989 | Friel . | |
| 4,850,149 | 7/1989 | Phillips . | |
| 5,036,731 | 8/1991 | Fletcher . | |
| 5,547,419 | 8/1996 | Hulnicki . | |
| 5,643,059 | 7/1997 | Chen | 451/45 |

*Primary Examiner*—Derris Holt Banks
*Attorney, Agent, or Firm*—Lee, Mann, Smith, McWilliams, Sweeney & Ohlson

[57] ABSTRACT

A sharpening apparatus for sharpening blades of tools and other implements such as spatulas and grill scrapers. The sharpening apparatus includes a base member on which a sharpening stone is positioned. A slidable blade guide member is slidably connected to the base member. The slidable blade guide member includes a guide surface that is disposed at an angle relative to the upper surface of the sharpening stone, and a mounting mechanism for removably mounting a spatula against the guide surface such that the scraping edge of the spatula is in engagement with the sharpening stone. The slidable blade guide member is manually slidable back and forth to sharpen the scraping edge of the spatula. A fixed blade guide member is also attached to the base member. The fixed blade guide member includes a horizontal slot that is adapted to receive the shaft of a grill scraper and that is adapted to provide guided back and forth sliding movement of the grill scraper within the slot and in engagement with the sharpening member to sharpen the scraping edge of the grill scraper.

24 Claims, 5 Drawing Sheets

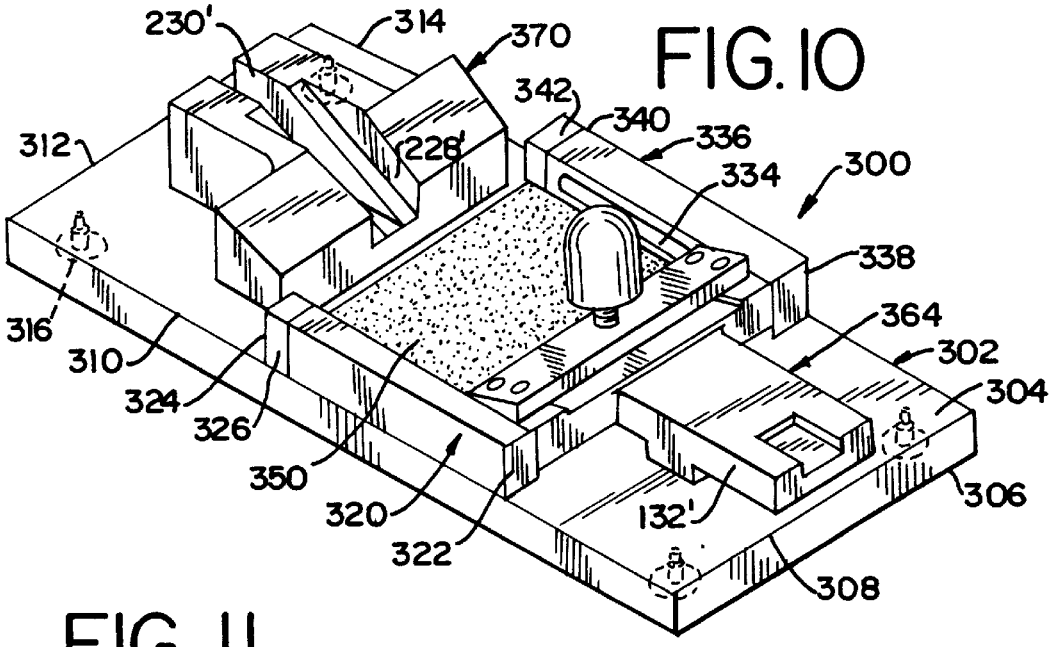
FIG. 10
FIG. 11
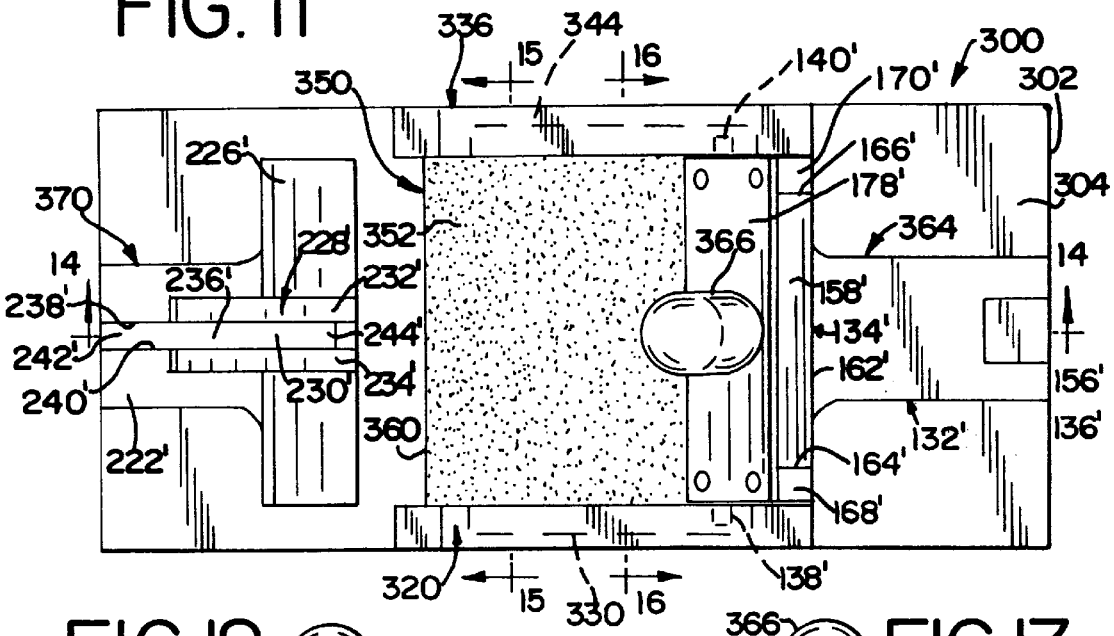
FIG. 12
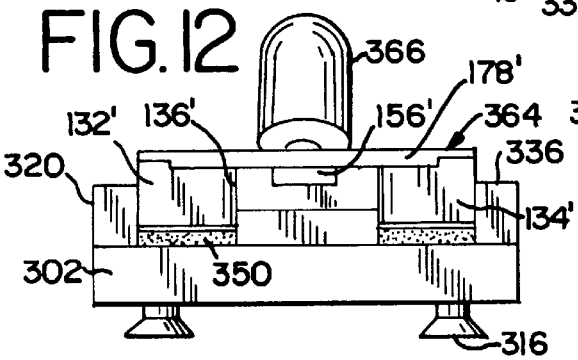
FIG. 13
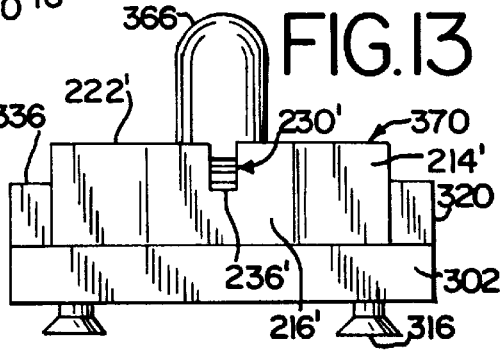

SHARPENING APPARATUS

RELATED APPLICATIONS

This application claims the benefit of U.S. Provisional Application No. 60/058,340, filed Sep. 10, 1997.

BACKGROUND OF THE INVENTION

The present invention is an apparatus for sharpening bladed tools including grill implements such as spatulas and grill scrapers, and in particular a sharpening apparatus having a sharpening member, a first blade guide member that is slidable with respect to the sharpening member, and a second blade guide member that is fixed with respect to the sharpening member.

In the food preparation industry various types of food products, including meat products such as hamburgers, sausage patties and bacon, are cooked on metal grills having a substantially planar and nonperforate surface that is heated. Properly cooking a meat product on a grill, wherein the resulting cooked meat product has maximum flavor and is sufficiently cooked such that it is safe to eat, requires the use of sharp grill implements such as spatulas and grill scrapers for cleaning the grill before, during and after the cooking process.

The use of a dull or unevenly sharpened spatula during the cooking process will tear and cut the meat product when the meat product is picked-up or turned-over on the grill with the spatula. This results in a torn surface in the meat product through which juices may be lost and results in a portion of the meat product remaining adhered to the grill where it may become burned or where it may build up harmful bacteria. A properly sharpened spatula that has a smooth, sharp, straight and burr-free edge will cleanly pick up a meat product from the grill without tearing the seared surface of the meat product, such that natural juices are retained in the meat product, and without leaving any portion of the meat product adhered to the grill.

The use of a dull or unevenly sharpened grill scraper to clean a grill prior to cooking also leads to many problems. A grill surface that is not properly cleaned due to the use of a dull or unevenly sharpened grill scraper will allow carbon to accumulate on the surface of the grill. A dull or unevenly sharpened grill scraper can also scratch the grill surface such that carbon can build up in the grooves of the scratches. A food product that is cooked on a grill having carbon on its surface can acquire a bad taste. A build up of carbon on the grill surface also results in uneven heat transfer to the meat product which can cause the resulting meat product to be improperly under cooked such that it may contain potentially harmful bacteria or *E. coli* due to its under cooking. The use of spatulas and grill scrapers having a sharp, straight and smooth edge in connection with a grill is necessary to enable the safe cooking of food products on a grill.

SUMMARY OF THE INVENTION

The present invention provides a sharpening apparatus for sharpening blades of tools and grill implements such as spatulas and grill scrapers. The sharpening apparatus includes a base member having an upper surface, a generally linear left guide rail and a generally linear right guide rail, each guide rail being located generally parallel to and spaced apart from one another. The left guide rail includes an interior surface having a first guideway comprising a first generally horizontal groove. The left guide rail also includes a second generally horizontal groove. The right guide rail includes an interior surface having a second guideway comprising a third generally horizontal groove. The right guide rail also includes a fourth generally horizontal groove. A sharpening member having a generally planar upper surface is located on the upper surface of the base member and extends from within the second groove of the left guide rail to within the fourth groove of the right guide rail, such that the left guide rail and right guide rail firmly hold the sharpening member in position relative to the base member.

A slidable blade guide member extends between the left guide rail and the right guide rail. The slidable blade guide member includes a first slide member located within the first guideway of the left guide rail and a second slide member that is located within the second guideway of the right guide rail such that the slidable blade guide member is slidably attached to the left guide rail and the right guide rail. The slidable blade guide member includes a guide surface that is disposed at an angle relative to the upper surface of the sharpening member. The slidable blade guide member includes a mounting mechanism for removably mounting the blade of a tool or implement, such as a spatula, against the guide surface such that the cutting or scraping edge of the blade is in engagement with the sharpening member. The slidable blade guide member may be manually slid horizontally back and forth within the guideways of the left guide rail and the right guide rail thereby sliding the cutting or scraping edge of the blade over the surface of the sharpening member and creating a sharp, linear and smooth cutting or scraping edge on the blade of the tool or implement.

A fixed blade guide member is stationarily attached to the base member. The fixed blade guide member includes a slot extending therethrough forming a bottom wall and two opposing vertical side walls. The bottom wall is disposed at an angle relative to the upper surface of the sharpening member. The shaft of a tool or implement such as a grill scraper is placed within the slot of the fixed blade guide member with the cutting or scraping edge of the blade of the tool in engagement with the sharpening member. The implement is then manually slid back and forth in a generally horizontal direction within the slot such that the cutting or scraping edge of the implement slides over the sharpening member thereby creating a sharp, linear and smooth scraping edge on the blade of the implement.

BRIEF DESCRIPTION OF THE DRAWING FIGURES

FIG. 10 is a perspective view of a second embodiment of the sharpening apparatus of the present invention.

FIG. 11 is a top plan view of the sharpening apparatus of FIG. 10.

FIG. 12 is a right side elevational view showing the slidable guide member of the sharpening apparatus.

FIG. 13 is a left side elevational view showing the fixed guide member of the sharpening apparatus.

DETAILED DESCRIPTION OF THE PREFERRED EMBODIMENTS

Figure 2:
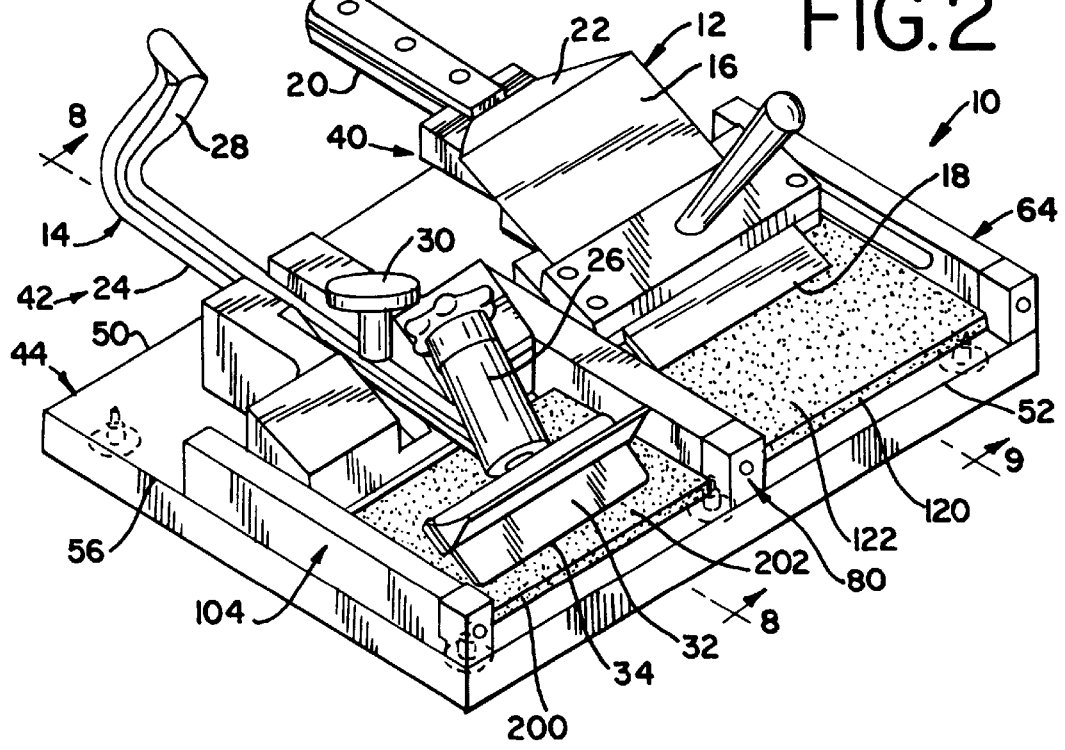
FIG. 2 is a perspective view of the first embodiment of the sharpening apparatus showing a spatula and a grill scraper in position for sharpening.
Figure 8:
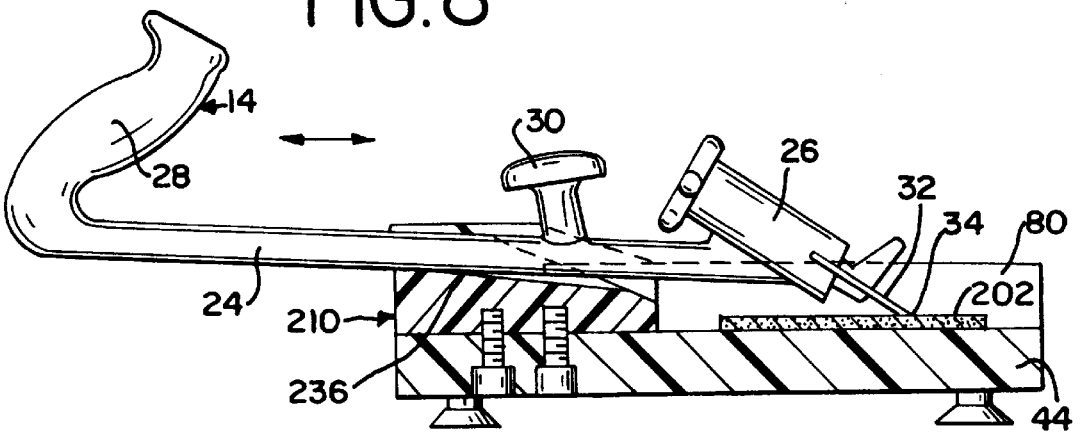
FIG. 8 is a cross sectional view of the sharpening apparatus and a side elevational view of the grill scraper taken along lines 8—8 of FIG. 2.
Figure 9:
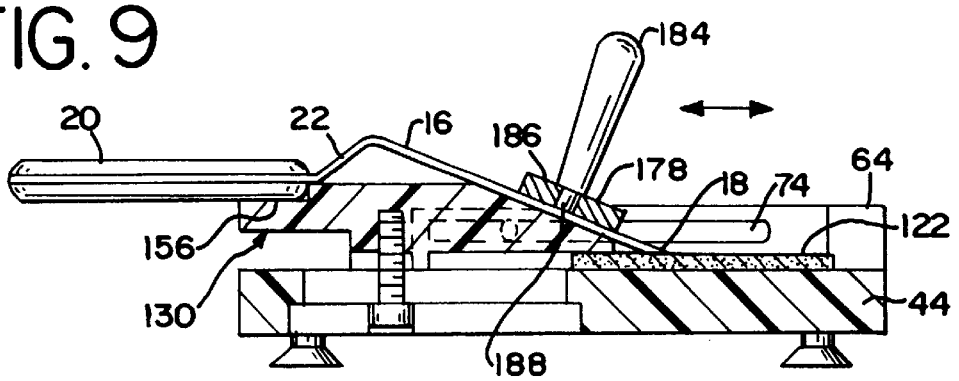
FIG. 9 is a cross sectional view of the sharpening apparatus and a side elevational view of the spatula taken along lines 9—9 of FIG. 2.
Figure 14:
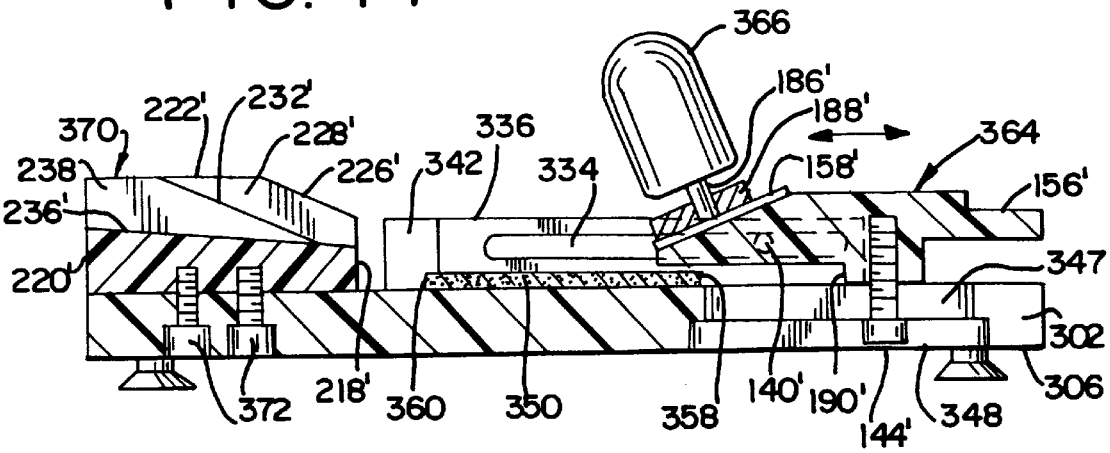
FIG. 14 is a cross sectional view taken along lines 14—14 of FIG. 11.
Figure 15:
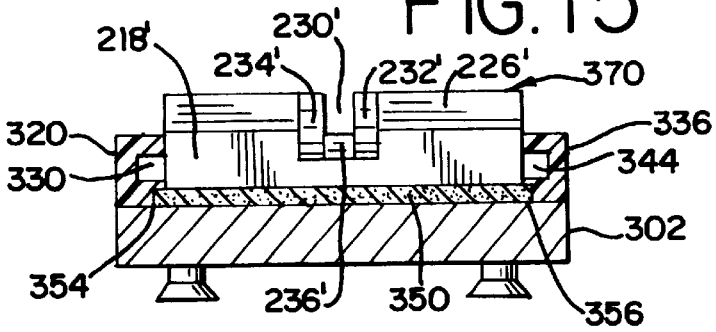
FIG. 15 is a cross sectional view taken along lines 15—15 of FIG. 11.
Figure 16:
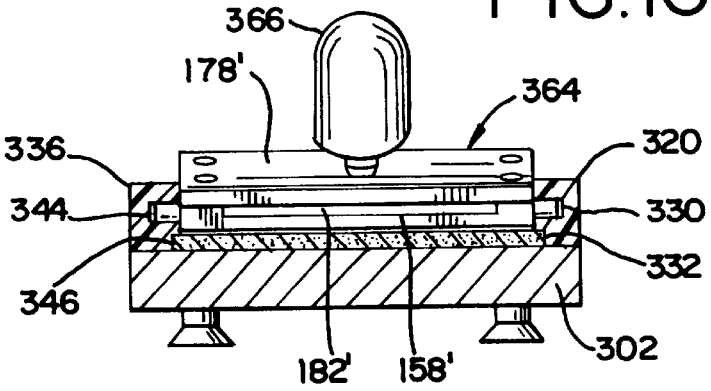
FIG. 16 is a cross sectional view taken along lines 16—16 of FIG. 11.

The sharpening apparatus of the present invention is adapted to sharpen the cutting or scraping edge of a tool or other implement, including grill implements such as a spatula 12 or a grill scraper 14 that are used in connection with a cooking grill having a substantially planar and nonperforate metal surface. As best shown in FIGS. 2 and 9, the spatula 12 includes a generally planar metal blade 16 having a generally linear scraping edge 18. The spatula 12 also includes a handle 20 that is attached to the blade 16 by a web portion 22 that extends from the rear edge of the blade 16 at an angle to the blade 16. As shown in FIGS. 2 and 8, the grill scraper 14 includes a shaft 24 having a blade holding mechanism 26 attached at a forward end of the shaft 24 and a rear handle 28 attached to the rear end of the shaft 24. A front handle 30 is attached to the shaft 24 slightly behind the blade holding mechanism 26. The blade holding mechanism 26 includes a removable generally planar blade 32 having a generally linear scraping edge 34. The spatula 12 and grill scraper 14 are implements presently in use in connection with grills. The sharpening apparatus of the present invention may also be used to sharpen various other types of tools and implements having a cutting or scraping edge such as, but not limited to, paint scrapers, putty knives, chisels, cutting blades and scraper blades.

Figure 1:
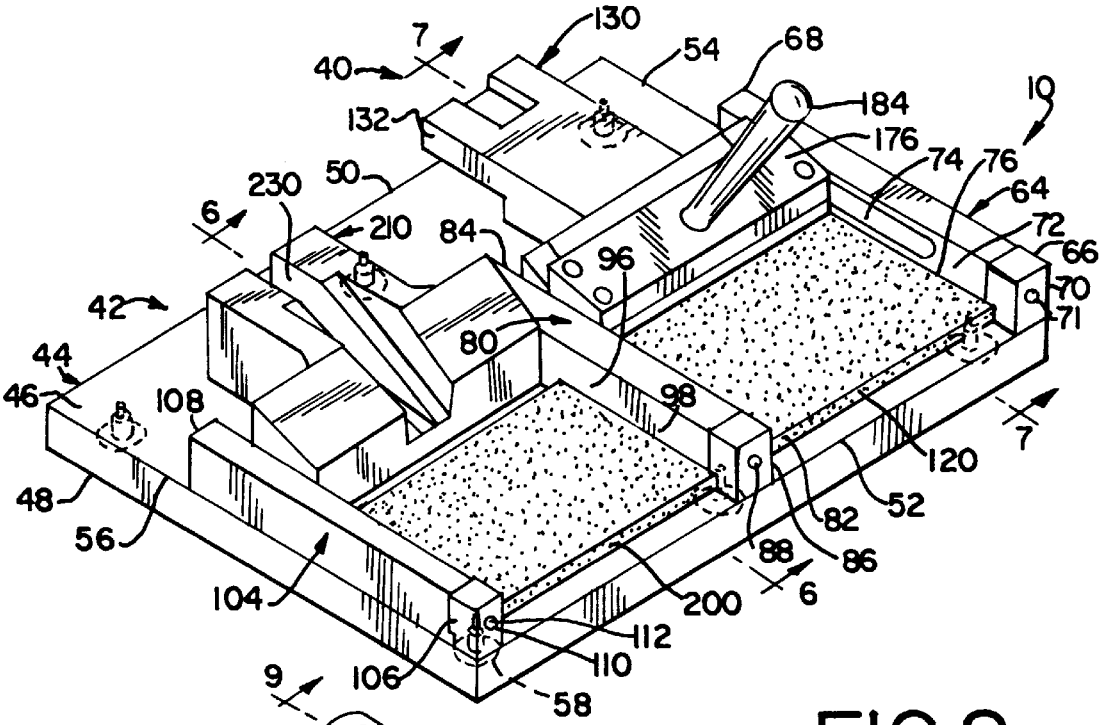
FIG. 1 is a perspective view of a first embodiment of the sharpening apparatus of the present invention.
Figure 3:
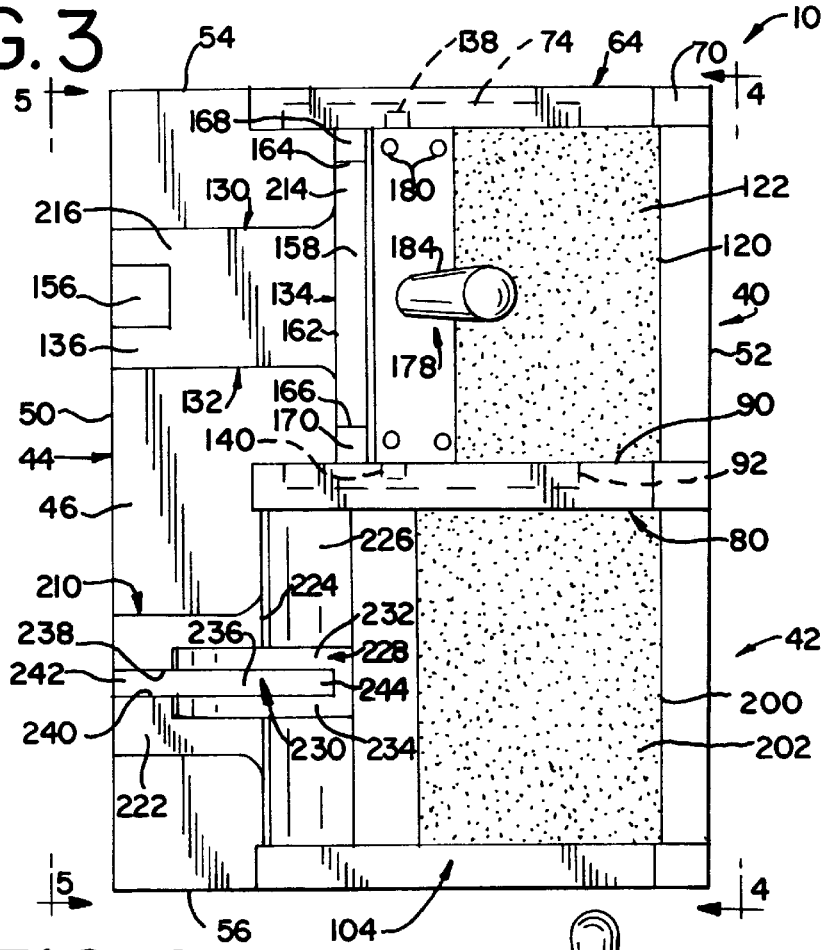
FIG. 3 is a top plan view of the sharpening apparatus of FIG. 1.
Figure 4:
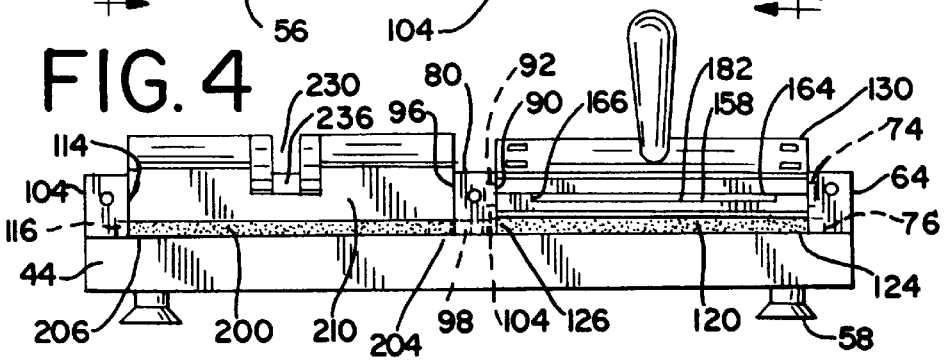
FIG. 4 is a rear elevational view of the sharpening apparatus of FIG. 1 taken along lines 4—4 of FIG. 3.
Figure 5:
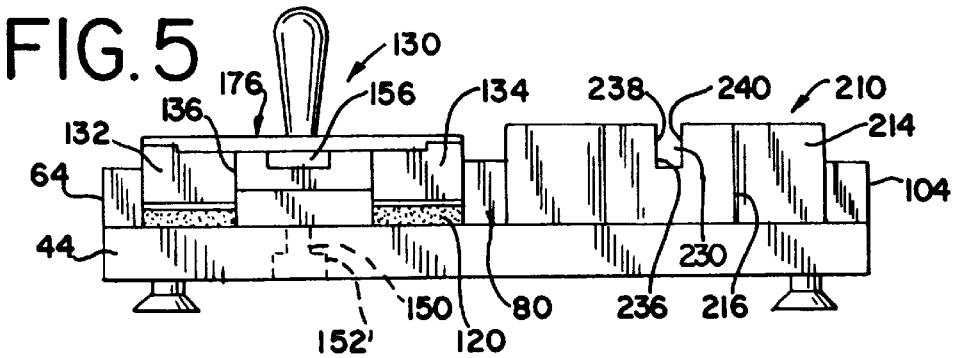
FIG. 5 is a front elevational view of the sharpening apparatus of FIG. 1 taken along lines 5—5 of FIG. 3.
Figure 6:
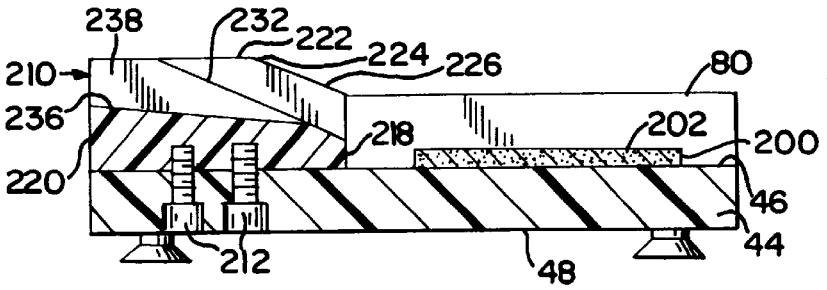
FIG. 6 is a cross sectional view of the fixed blade guide sharpening arrangement taken along lines 6—6 of FIG. 1.

One embodiment of the sharpening apparatus of the present invention is shown in FIGS. 1–9 and is identified with the reference number 10. As best shown in FIGS. 1–3, the sharpening apparatus 10 includes a slidable blade guide sharpening arrangement 40 and a fixed blade guide sharpening arrangement 42 combined in a single device. Alternatively, the slidable blade guide sharpening arrangement 40 and the fixed blade guide sharpening arrangement 42 can comprise separate individual devices. The sharpening apparatus 10 includes a generally rectangular base member 44 having a generally planar upper surface 46 and a spaced apart generally planar lower surface 48. The upper surface 46 includes a front edge 50, a rear edge 52, a left edge 54 and a right edge 56. The base 44 is preferably formed from a polypropylene plastic material. A plurality of feet 58 are attached to and extend downwardly from the lower surface 48 of the base 44. The feet 58 preferably comprise suction cups formed from neoprene rubber such that the feet 58 can removably attach the sharpening apparatus 10 firmly in place on the surface of a countertop for use.

The base member 44 includes a left guide rail 64 that extends upwardly from the upper surface 46 of the base member 44 and that extends linearly from the rear edge 52 and along the left edge 54 of the base 44 to a position spaced apart from the front edge 50. The left guide rail 64 is in the general shape of a rectangular parallelepiped. The left guide rail 64 extends between a first end 66 and a second end 68. The first end 66 includes a removable end cap 70 that is selectively attached to the left guide rail 64 by a fastener 71. The left guide rail 64 includes a generally vertical and planar interior surface 72. A first guideway comprising an upper horizontal groove 74 is located in the interior surface 72 of the left guide rail 64. A lower horizontal groove 76 is located in the interior surface 72 of the left guide rail 64 adjacent to the upper surface 46 of the base 44. The groove 76 extends into the end cap 70. The grooves 74 and 76 are generally linear and parallel to one another, with the groove 74 being located at a greater height above the upper surface 46 of the base 44 than the groove 76.

The base member 44 also includes a center guide rail 80 having a first end 82 and a second end 84. The center guide rail 80 is formed as a generally rectangular parallelepiped. The first end 82 of the center guide rail 80 includes a removable end cap 86 that is attached to the center guide rail 80 by a fastener 88. The center guide rail 80 extends generally upwardly from the upper surface 46 of the base 44 and extends linearly generally parallel to and approximately midway between the left and right edges 54 and 56 of the base 44 from the rear edge 52 to a position spaced apart from the front edge 50. The center guide rail 80 includes a left surface 90 that is generally vertical and planar. The left surface 90 includes a second guideway comprising an upper horizontal groove 92 that is located in opposition to the groove 74 in the left guide rail 64. The left surface 90 of the center guide rail 80 also includes a lower horizontal groove 94 that is formed adjacent to the upper surface 46 of the base 44. The lower groove 94 extends into the end cap 86 and is positioned opposite the groove 76 in the left guide rail 64. The center guide rail 80 also includes a right surface 96 that is generally vertical and planar and that is generally parallel with the left surface 90. The right surface 96 includes a horizontal groove 98 that is formed adjacent to the upper surface 46 of the base 44 and that extends into the end cap 86.

The base member 44 also includes a right guide rail 104 that extends linearly between a first end 106 and a second end 108. The right guide rail 104 is formed as a generally rectangular parallelepiped. The right guide rail 104 extends upwardly from the upper surface 46 of the base 44 from the rear edge 52 and along the right edge 56 of the base 44 to a position spaced apart from the front edge 50. The right guide rail 104 includes a removable end cap 110 at the first end 106 that is selectively attached to the right guide rail 104 by a fastener 112. The right guide rail 104 includes an interior surface 114 that is generally vertical and planar. The interior surface 114 includes a horizontal groove 116 that is located adjacent the upper surface 46 of the base 44. The groove 116 extends into the end cap 110. The groove 116 is located opposite from the groove 98 in the right surface 96 of the center guide rail 80. The guide rails 64, 80 and 104 are all located generally parallel to one another and they all have approximately the same length between their first and second ends. The guide rails 64, 80 and 104, and their end caps 70, 86 and 110, are preferably made from polypropylene plastic. The fasteners 71, 88 and 112 are preferably made from stainless steel.

The slidable blade guide sharpening arrangement 40 of the sharpening apparatus 10 includes a sharpening member 120, such as a sharpening stone, having a generally planar upper surface 122 that extends between a first end 124 and a second end 126. The sharpening member 120 is located on the upper surface 46 of the base 44 such that the first end 124 is located within the groove 76 of the left guide rail 64 and such that the second end 126 of the sharpening member 120 is located within the groove 94 of the center guide rail 80. The sharpening member 120 substantially fills each of the grooves 76 and 94 such that the left guide rail 64 and the center guide rail 80 firmly hold the sharpening member 120 in place relative to the base 44. The end caps 70 and 86 may be removed from the left guide rail 64 and center guide rail 80 such that the sharpening member 120 may be slid horizontally out of the grooves 76 and 94 for removal from the sharpening apparatus 10. The sharpening member 120 may then be rotated 180° and reinserted or a new sharpening member may be inserted into the grooves 76 and 94, whereupon the end caps 70 and 86 are replaced and reattached to the guide rails 64 and 80. The sharpening member is preferably approximately five inches wide by seven inches long and approximately ⅛ inch thick. The sharpening member 120 is preferably made from eighty grit material, but other size grits may be used as desired. The sharpening member 120 may be made from materials such as stone, metal, ceramics, and other materials that are typically used to sharpen a cutting or scraping edge.

The slidable blade guide sharpening arrangement 40 of the sharpening apparatus 10 also includes a slidable blade guide member 130 that is slidably attached to the left guide rail 64, the center guide rail 80 and the base 44, The guide member 130 includes a generally T-shaped carrier member 132 having a generally rectangular head 134 that extends transversely between the left guide rail 64 and the center guide rail 80, and a stem 136 which extends generally perpendicularly from the head 134 towards the front edge 50 of the base 44. The head 134 includes a first slide member, such as a pin 138, that extends into the groove 74 of the left guide rail 64. The head 134 includes a second slide member, such as a pin 140, that extends into the groove 92 of the center guide rail 80. The pins 138 and 140 each have a diameter that is smaller than the width of the grooves 74 and 92. The pins 138 and 140 are respectively slidable within the grooves 74 and 92 and are able to move a short distance vertically between the top and bottom walls of the grooves 74 and 92. The pins 138 and 140 slidably connect the carrier member 132 to the base member 44.

Figure 7:
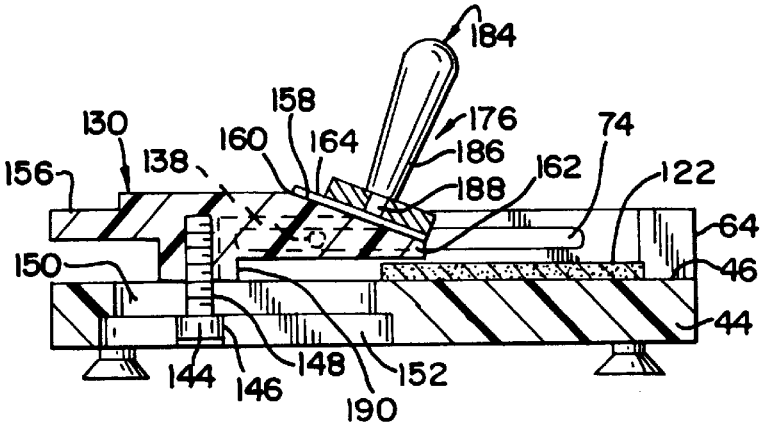
FIG. 7 is a cross sectional view of the slidable blade guide sharpening arrangement taken along lines 7—7 of FIG. 1.

As best shown in FIG. 7, the stem 136 of the carrier member 132 is slidably attached to the base 44 by a slide member such as a fastener 144 having a head 146 and a shank 148. The base 44 includes a third guideway comprising an elongate slot 150 that extends downwardly from the upper surface 46. The slot 150 is in communication with a groove 152 formed in the lower surface 48 of the base 44. The slot 150 and the groove 152 extend parallel to one another. The slot 150 includes a central longitudinal axis that is located vertically above a central longitudinal axis of the groove 152. The slot 150 has a width sized such that the shank 148 of the fastener 144 will fit therethrough, but such that the head 146 of the fastener 144 will not fit through the slot 150. The groove 152 is slightly wider and longer than the slot 150 such that the head 146 of the fastener 144 will fit within the groove 152. The fastener 144 is slidable along the length of the slot 150. The slot 150 extends generally parallel to the left guide rail 64 and the center guide rail 80.

The outer end of the stem 136 of the carrier member 132 includes a generally rectangular receptacle 156 in its upper surface that is adapted to receive a portion of the handle 20 of the spatula 12 as best shown in FIG. 9. The head 134 of the carrier member 132 includes an upper guide surface 158 that is generally planar and that is disposed at an angle relative to the upper surface 122 of the sharpening member 120. The guide surface 158 is disposed at an angle to the sharpening member surface 122 that will provide the proper sharpening angle between the blade 16 of the spatula 12 and the upper surface 122 of the sharpening member 120. The guide surface 158 extends between a front edge 160 and a rear edge 162. The guide surface 158 also extends between a left shoulder 164 and a right shoulder 166 that extend upwardly from the head 134 above the guide surface 158. The left shoulder 164 is located adjacent the left guide rail 64 and the right shoulder 166 is located adjacent the center guide rail 80. The left shoulder 164 includes an upper surface 168 and the right shoulder 166 includes an upper surface 170. The carrier member 132 is preferably made of polypropylene plastic. The pins 138 and 140 and the fastener 144 are preferably made from stainless steel.

A mounting mechanism 176 is attached to the shoulders 164 and 166 of the carrier member 132. The mounting mechanism 176 includes a generally rectangular mounting member 178, such as a generally rectangular bar, that is attached at each end respectively to the upper surface 168 of the left shoulder 164 and the upper surface 170 of the right shoulder 166 by a plurality of fasteners 180. A generally rectangular slot 182 is formed between the guide surface 158 and the mounting member 178 and between the left and right shoulders 164 and 166. The mounting mechanism 176 also includes a handle 184 and a clamping member such as a threaded stud 186 that projects outwardly from one end of the handle 184. The stud 186 is threadably engaged with a threaded bore 188 that is generally centrally located within the mounting member 178 and that extends therethrough to the slot 182. The stud 186 is adapted to be threadably inserted through the bore 188 such that the tip of the stud 186 extends into the slot 182.

The guide member 130 is adapted to horizontally slide back and forth in the grooves 74 and 92 and in the slot 150, with the head 134 of the guide member 130 adapted to slide above the upper surface 122 of the sharpening member 120. The head 134 of the guide member 130 can be located at slightly different elevations above the sharpening member 120 due to the difference of the diameter of the pins 138 and 140 with respect to the width of the grooves 74 and 92. The bottom of the stem 136 includes a lip 190 that is adapted to engage the forward edge of the sharpening member 120 that is located most closely adjacent to the slot 150 when the guide member 130 is slid all the way toward the rear edge 52 of the base 44 to prevent further sliding movement of the guide member 30 in that direction. The mounting member 178 and the stud 186 of the mounting mechanism 176 are preferably made from stainless steel. The handle 184 is preferably formed from Delrin plastic, polypropylene, or other materials.

The fixed blade guide sharpening arrangement 42 of the sharpening apparatus 10 includes a sharpening member 200, such as a sharpening stone, that is preferably constructed identically to the sharpening member 120. The sharpening member 200 includes a generally planar upper surface 202 and extends between a first end 204 and a second end 206. The first end 204 of the sharpening member 200 is adapted to be located within the groove 98 of the center guide rail 80 and the second end 206 of the sharpening member 200 is adapted to be located within the groove 116 of the right guard rail 104. The sharpening member 200 substantially fills the grooves 98 and 116 such that the sharpening member 200 is held firmly in place against the upper surface 46 of the base 44 by the guide rails 80 and 104. The end cap 86 may be removed from the center guide rail 80 and the end cap 110 may be removed from the right guard rail 104 to permit the sharpening member 200 to be slidably removed from the center guide rail 80 and right guide rail 104 and rotated 180° for reinsertion, or such that a new sharpening member may be inserted. If desired, a single sharpening member could be used in place of the two sharpening members 120 and 200 that would extend from the left guide rail 64, through a slot formed between the center guide rail 80 and base 44, to the right guide rail 104. The sharpening member 200 may be made from materials such as stone, metal, ceramics, or other materials that are typically used to sharpen a cutting or scraping edge.

The fixed blade guide sharpening arrangement 42 of the sharpening apparatus 10 includes a fixed blade guide member 210 that is attached to the upper surface 46 of the base 44 in a fixed position by a plurality of fasteners 212. The guide member 210 is generally T-shaped as shown in FIG. 3 and includes a head 214 that extends transversely between the center guide rail 80 and the right guide rail 104, and a stem 216 that extends transversely from the head 214 to the front edge 50 of the base 44. The head 214 is located adjacent the second end 84 of the center guide rail 80 and the second end 108 of the right guide rail 104. The guide member 210 includes a generally planar rear surface 218 that extends vertically upward from the upper surface 46 of the base 44. The guide member 210 also includes a generally planar front surface 220 that extends generally vertically upward from adjacent the front edge 50 of the base 44. The rear surface 218 and front surface 220 are generally parallel to one another. The guide member 210 also includes a top surface 222 that extends generally horizontally from the top edge of the front surface 220 to an edge 224. A generally planar surface 226 extends from the edge 224 of the top surface 222 to the top edge of the rear surface 218. The surface 226 is disposed at an angle to the top surface 222. The top surface 222 is generally parallel to the upper surface 202 of the sharpening member 200.

The fixed blade guide member 210 includes a recess 228 and a generally horizontal and linear slot 230. The recess 228 forms an inclined planar bottom wall 232 and an inclined planar bottom wall 234 that are generally coplanar with one another and that are located on opposite sides of the slot 230. The bottom walls 232 and 234 extend from the top surface 222 to the rear surface 218. The bottom walls 232 and 234 are disposed at an angle of approximately twenty degrees relative to the upper surface 202 of the sharpening member 200. The slot 230 extends from the front surface 220 to the bottom walls 232 and 234 of the recess 228. The slot 230 forms a planar bottom wall 236 and two opposing planar side walls 238 and 240 that extend vertically upwardly from the bottom wall 236. The side wall 238 intersects with the top surface 222 and with the bottom wall 232 of the recess 228. The side wall 240 intersects with the top surface 222 and with the bottom wall 234 of the recess 228. The bottom wall 236 is disposed at an angle of approximately five degrees relative to the upper surface 202 of the sharpening member 200. The bottom wall 236 includes a front end 242 and a rear end 244. The front end 242 of the bottom wall 236 is located vertically farther above the upper surface 46 of the base 44 than is the rear end 244 of the bottom wall 236.

The slot 230 is adapted to receive the shaft 24 of the grill scraper 14 such that the shaft may slide longitudinally back and forth against the bottom wall 236 of the slot 230 and between the side walls 238 and 240 of the slot 230. The recess 228 is adapted to receive a portion of the blade holding mechanism 26 of the grill scraper 14. The angle of the bottom wall 236 relative to the upper surface 202 of the sharpening member 200 and the height of the bottom wall 236 above the plane of the upper surface 202 of the sharpening member 200 are positioned such that the blade 32 of the grill scraper 14 is disposed at the desired sharpening angle relative to the upper surface 202 of the sharpening member 200.

In operation, as shown in FIG. 9, the head 134 of the slidable blade guide member 130 is raised such that the pins 138 and 140 are located against the top wall of the grooves 74 and 92 and the blade 16 of the spatula 12 is inserted through the slot 182 in the slidable blade guide member 130 and the scraping edge 18 of the spatula 12 is positioned in engagement with the upper surface 122 of the sharpening member 120. A portion of the handle 20 of the spatula 12 is located within the rectangular receptacle 156. The handle 184 of the mounting mechanism 176 is then rotated about its longitudinal axis to advance the stud 186 through the bore 188 until the tip of the stud 186 engages the blade 16. The handle 184 is then further rotated such that the stud 186 presses the blade 16 against the guide surface 158 whereupon the blade 16 is firmly clamped between the guide surface 158 and the stud 186 of the mounting mechanism 176. The spatula 12 is thereby firmly clamped to the guide member 130. The handle 184 may then be manually grasped to slide the guide member 130 and the spatula 12 horizontally in a back and forth linear motion while pressing the scraping edge 18 of the spatula 12 downwardly against the upper surface 122 of the sharpening member 120 at a constant angle. The back and forth guided sliding motion of the spatula 12 in engagement with the sharpening member 120 creates a sharp, linear, smooth and burr-free scraping edge 18 on the spatula 12. The guide surface 158 of the guide member 130 positions the blade 16 of the spatula 12 at the proper angle relative to the upper surface 122 of the sharpening member 120 to create the proper cutting angle at the scraping edge 18 of the spatula 12. The blade 16 is preferably disposed at an angle of approximately twenty degrees relative to the upper surface 122 of the sharpening member 120, but may be positioned at other angles.

Once the guide member 130 and spatula 12 have been slid back and forth a sufficient number of times over the sharpening member 120 to sharpen the scraping edge 18, the handle 184 is then rotated about its longitudinal axis in the opposite direction to retract the stud 186 from the blade 16 of the spatula 12 and thereby release the blade 16. The blade 16 of the spatula 12 is then removed from the slot 182. The spatula 12 is then sharpened although it should be washed before use.

The grill scraper 14 is sharpened by placing the shaft 24 within the slot 230 of the fixed blade guide member 210 such that the shaft 24 rests on the bottom wall 236 and such that the scraping edge 34 of the blade 32 of the grill scraper 14 engages the upper surface 202 of the sharpening member 200. The handles 28 and 30 of the grill scraper 14 are then manually grasped and the grill scraper 14 is slid longitudinally in a back and forth horizontal direction within the slot 230. The shaft 24 fits closely between the side walls 238 and 240 of the slot 230 to maintain the sliding movement of the grill scraper 14 in a linear direction. The bottom wall 236 positions the grill scraper 14 and the blade 32 at the proper angle to the upper surface 202 of the sharpening member 200 to create a cutting edge with the desired angle at the scraping edge 34. The blade 32 is preferably disposed at an angle of approximately thirty degrees relative to the upper surface 202 of the sharpening member 200, but may be positioned at other angles. The back and forth guided sliding movement of the blade 32 over the sharpening member 200 creates a sharp, linear, smooth and burr-free scraping edge 34 on the blade 32. The grill scraper 14 may then be removed from the slot 230 and the guide member 210. The grill scraper 14 is then sharpened although it should be washed before use.

A second embodiment of the sharpening apparatus of the present invention is shown in FIGS. 10–16 and is identified with the reference number 300. The sharpening apparatus 300 includes a generally rectangular base member 302 having a generally planar upper surface 304 and a spaced apart generally planar lower surface 306. The upper surface 304 includes a first edge 308, a second edge 310, a third edge 312 and a fourth edge 314. The base member 302 is preferably formed from a polypropylene plastic material. A plurality of feet 316, that preferably comprise suction cups, extend downwardly from the lower surface 306.

The base member 302 includes a first guide rail 320 that is connected to and extends upwardly from the upper surface 304 of the base member 302. The first guide rail 320 extends linearly along the second edge 310 of the base member 302 and is generally centrally located between the first edge 308 and third edge 312 of the base member 302. The first guide rail 320 is constructed generally identically to the left guide rail 64 of the sharpening apparatus 10. The first guide rail 320 extends between a first end 322 and a second end 324. The second end 324 includes a removable end cap 326 that is selectively attached to the first guide rail 320 by a fastener. The first guide rail 320 includes a generally vertical and planar interior surface that includes a first guideway comprising an upper horizontal groove 330. A lower horizontal groove 332 is located in the interior surface of the first guide rail 320 adjacent to the upper surface 304 of the base member 302. The grooves 330 and 332 are generally linear and parallel to one another, with the groove 330 being located at a greater height above the upper surface 304 of the base member 302 than the groove 332.

The base member 302 also includes a second guide rail 336 having a first end 338 and a second end 340. The second end 340 includes a removable end cap 342 that is attached to the second guide rail 336 by a fastener. The second guide rail 336 is connected to and extends upwardly from the upper surface 304 of the base member 302 and extends generally linearly along the fourth edge 314 of the base member 302. The second guide rail 336 is located approximately midway between the first edge 308 and the third edge 312 of the base member 302. The second guide rail 336 is spaced apart from and generally parallel to the first guide rail 320. The second guide rail 336 includes a generally vertical and planar interior surface that includes a second guideway comprising an upper horizontal groove 344 that is located in opposition to the upper horizontal groove 330 of the first guide rail 320. The interior surface of the second guide rail 336 also includes a lower horizontal groove 346 that is formed adjacent to the upper surface 304 of the base member 302. The lower horizontal groove 346 is located in opposition to the lower horizontal groove 332 of the first guide rail 320.

The base member 302 includes a third guideway comprising an elongate slot 347 that extends downwardly from the upper surface 304. The slot 347 is in communication with a groove 348 formed in the lower surface 306 of the base member 302. The slot 347 and the groove 348 extend parallel to one another. The slot 347 includes a central longitudinal axis that is located vertically above a central longitudinal axis of the groove 348. The slot 347 is narrower than the groove 348.

The sharpening apparatus 300 includes a sharpening member 350, such as a sharpening stone, having a generally planar upper surface 352 that extends between a first end 354, a second end 356 that opposes the first end 354, a third end 358, and a fourth end 360 that opposes the third end 358. The sharpening member 350 is located on the upper surface 304 of the base member 302 such that the first end 354 is located within the lower horizontal groove 332 of the first guide rail 320 and the second end 336 is located within the lower horizontal groove 346 of the second guide rail 336. The sharpening member 350 substantially fills the grooves 332 and 346 such that the guide rails 320 and 336 firmly hold the sharpening member 350 in place relative to the base member 302. The sharpening member 350 is preferably constructed identically to the sharpening member 200 of the sharpening apparatus 10.

The sharpening apparatus 300 includes a slidable blade guide member 364 that is slidably attached to the first guide rail 320, the second guide rail 336, and the base member 302. The slidable blade guide member 364 is constructed identically to the slidable blade guide member 130 of the sharpening apparatus 10, except that the slidable blade guide member 364 includes a handle 366 that has a different configuration than the configuration of the handle 184 of the slidable blade guide member 130. The structural elements of the slidable blade guide member 364 that correspond to the structural elements of the slidable blade guide member 130 are designated in FIGS. 10–16 and are referred to herein with the same reference numbers as used in FIGS. 1–9, but with the addition of a prime symbol (').

The slidable blade guide member 364 is slidably connected to the first guide rail 320 by a slide member comprising a pin 138' that is attached to the slidable blade guide member 364 and that extends into the guideway comprising the upper horizontal groove 330 of the first guide rail 320. The slidable blade guide member 364 is slidably connected to the second guide rail 336 by a slide member comprising a pin 140' that is attached to the slidable blade guide member 364 and that extends into the guideway comprising the upper horizontal groove 344 of the second guide rail 336. The slidable blade guide member 364 is slidably attached to the base member 302 by a fastener 144' that is connected to the slidable blade guide member 364 and that extends into the third guideway comprising the slot 347 of the base member 302. The slidable blade guide member 364 is slidably connected to the base member 302 such that it is selectively slidable in a back and forth generally horizontal direction with respect to the sharpening member 350 in the same manner as is the slidable guide member 130. The mounting mechanism 176' of the slidable blade guide member 364 is adapted to removably mount a spatula 12 to the slidable blade guide member 364 for sharpening in the same manner as the mounting mechanism 176 of the sharpening apparatus 10. The slidable blade guide member 364 is slidable between a first position as generally shown in FIG. 11, wherein the pins 138' and 140' are located adjacent the first ends 322 and 338 of the first and second guide rails 320 and 336, and a second position wherein the pins 138' and 140' are located generally adjacent to the second ends 324 and 340 of the first and second guide rails 320 and 336.

The sharpening apparatus 300 also includes a fixed blade guide member 370 that is constructed identically to the fixed blade guide member 210 of the sharpening apparatus 10. The elements of the fixed blade guide member 370 that correspond to the fixed blade guide member 210 are shown in FIGS. 10–16 and are referred to herein with the same reference numbers as used in FIGS. 1–9, but with the addition of a prime symbol (′). The fixed blade guide member 370 is removably connected to the base member 302 by a pair of fasteners 372. The slot 230′ in the fixed blade guide member 370 is adapted to receive the shaft 24 of the grill scraper 14 such that the shaft 24 may slide longitudinally back and forth in a guided manner, with the scraping edge 34 in engagement with the sharpening member 350, in the same manner as with the fixed guide member 210.

The slidable blade guide member 364 and the fixed blade guide member 370 are used to respectively sharpen the scraping edge 18 of the spatula 12 and the scraping edge 34 of the grill scraper 14 in the same manner as the slidable blade guide member 130 and the fixed blade guide member 210. As will be seen in comparing FIGS. 3 and 11, the slidable blade guide member 130 and the fixed blade guide member 210 operate in connection with respective sharpening members 120 and 200, or if the sharpening members 120 and 200 are formed as a single sharpening member, in connection with separate surface areas of the sharpening member. The slidable blade guide member 364 and the fixed blade guide member 370 of the sharpening apparatus 300 each operate to sharpen the cutting or scraping edge of an implement using the same surface area of the sharpening member 350.

The sharpening member 350 of the sharpening apparatus 300 may be removed by removing the fixed blade guide member 370 from the base member 302 and by removing the end caps 326 and 342 from the guide rails 320 and 336. The sharpening member 350 may then be slid horizontally out of the grooves 332 and 346 for removal from the sharpening apparatus 300. The sharpening member 350 may then be turned over 180° and reinserted, or a new sharpening member may be inserted into the grooves 332 and 346, whereupon the end caps 326 and 342 and the fixed blade guide member 370 are replaced.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A sharpening apparatus for sharpening an edge of a first implement and for sharpening an edge of a second implement, said sharpening apparatus including:

a base member;

one or more sharpening members associated with said base member, each said sharpening member having a surface adapted to sharpen the edge of the first or second implement;

a slidable guide member slidably connected to said base member such that said slidable guide member is selectively slidable with respect to a sharpening member, said slidable guide member including a mounting mechanism for removably mounting the first implement to said slidable guide member such that the edge of the first implement is in engagement with said surface of said sharpening member, wherein sliding movement of said slidable guide member with respect to said sharpening member provides guided movement of the edge of the first implement in sliding engagement with said surface of said sharpening member to thereby sharpen the edge of the first implement; and a fixed guide member connected to said base, said fixed guide member being stationarily fixed with respect to a sharpening member, said fixed guide member including a slot adapted to receive the second implement while the edge of the second implement is in engagement with said surface of said sharpening member, whereby the second implement is slidable within said slot to provide guided movement of the edge of the second implement in sliding engagement with said surface of said sharpening member to thereby sharpen the edge of the second implement.

2. The sharpening apparatus of claim 1 wherein said slidable guide member includes a guide surface adapted to position the first implement in a desired orientation with respect to said sharpening member with which said slidable guide member is selectively slidable, said mounting mechanism adapted to removably mount the first implement to said slidable guide member in engagement with said guide surface.

3. The sharpening apparatus of claim 2 wherein said slidable guide member includes a slot adapted to receive the first implement such that the first implement is in engagement with said guide surface.

4. The sharpening apparatus of claim 2 wherein said mounting mechanism includes a threaded clamping member threadably attached to said slidable guide member, said clamping member adapted to removably clamp the first implement in engagement with said guide surface.

5. The sharpening apparatus of claim 4 wherein said clamping member includes a handle adapted to provide rotational movement of said clamping member to removably clamp the first implement against said guide surface and to provide sliding movement of said slidable guide member with respect to said sharpening member.

6. The sharpening apparatus of claim 1 wherein said base member includes a first guideway and a second guideway, and said slidable guide member includes a first slide member and a second slide member, said first and second slide members being respectively slidable with respect to said first and second guideways and slidably connecting said slidable guide member to said base member.

7. The sharpening apparatus of claim 6 wherein said base member includes a first guide rail and a second guide rail, said sharpening member being located between said first guide rail and said second guide rail, said first guideway being located in said first guide rail and said second guideway being located in said second guide rail.

8. The sharpening apparatus of claim 7 wherein said first guideway comprises a first groove formed in said first guide rail and said second guideway comprises a second groove formed in said second guide rail.

9. The sharpening apparatus of claim 8 wherein said first guide rail includes a third groove and said second guide rail includes a fourth groove, said sharpening member extending into said third groove and into said fourth groove.

10. The sharpening apparatus of claim 6 wherein said base member includes a third guideway and said slidable guide member includes a third slide member, said third slide member being slidable with respect to said third guideway and slidably connecting said slidable guide member to said base member.

11. The sharpening apparatus of claim 10 wherein said first, second and third guideways are located generally parallel to one another.

12. The sharpening apparatus of claim 1 wherein said slidable guide member and said fixed guide member are generally located on respectively opposite sides of said sharpening member.

13. The sharpening apparatus of claim 1 wherein said slot of said fixed guide member forms a bottom wall, a first side wall and a second side wall spaced apart from said first side wall.

14. The sharpening apparatus of claim 13 wherein said fixed guide member includes a first inclined surface and a second inclined surface, said first and second inclined surfaces being respectively located on opposite sides of said slot, each said first and second inclined surface extending from a rear surface of said fixed guide member to a top surface of said fixed guide member generally perpendicular to said first and second side walls.

15. A sharpening apparatus for sharpening an edge of an implement, said sharpening apparatus including:

a base member having a first guideway, a second guideway spaced apart from and generally parallel to said first guideway, and a third guideway;

a sharpening member associated with said base member, said sharpening member having a surface adapted to sharpen the edge of the implement;

a slidable guide member having a first slide member slidable with respect to said first guideway, a second slide member slidable with respect to said second guideway, and a third slide member slidable with respect to said third guideway, said first, second and third slide members slidably connecting said slidable guide member to said base member, a guide surface adapted to position the implement in engagement with said sharpening member in a desired orientation with respect to said sharpening member, and a mounting mechanism for removably mounting the implement to said slidable guide member in engagement with said guide surface;

whereby sliding movement of said slidable guide member is adapted to slide the edge of the implement in engagement with said surface of said sharpening member to thereby sharpen the edge of the implement.

16. The sharpening apparatus of claim 15 wherein said base member includes a first guide rail and a second guide rail, said first guide rail including said first guideway and said second guide rail including said second guideway.

17. The sharpening apparatus of claim 16 wherein said sharpening member is located between said first guide rail and said second guide rail.

18. The sharpening apparatus of claim 15 wherein said slidable guide member includes a carrier member, said carrier member including said guide surface and said first slide member, and said mounting mechanism includes a clamping member and a mounting member, said mounting member being attached to said carrier member in spaced relation to said guide surface thereby forming a slot therebetween adapted to receive the implement, said clamping member being attached to said mounting member for removably clamping the implement in engagement with said guide surface.

19. The sharpening apparatus of claim 18 wherein said clamping member comprises a threaded member threadably attached to said mounting member, said threaded member being selectively extendable into said slot.

20. The sharpening apparatus of claim 19 including a handle attached to said threaded member, said handle adapted to provide rotation of said threaded member and sliding movement of said slidable guide member.

21. A sharpening apparatus for sharpening an edge of an implement, said sharpening apparatus including:

a base member;

a sharpening member associated with said base member, said sharpening member having a surface adapted to sharpen the edge of the implement;

a guide member stationary connected to said base member in a fixed position, said guide member having a slot forming a bottom wall, a first side wall and a second side wall, said slot adapted to receive the implement with the edge of the implement in engagement with said surface of said sharpening member, whereby the implement is slidable back and forth within said slot to provide guided movement of the edge of the implement in sliding engagement with said surface of said sharpening member to thereby sharpen the edge of the implement.

22. The sharpening apparatus of claim 21 wherein said guide member includes a first inclined surface and a second inclined surface, said first and second inclined surfaces being respectively located on opposite sides of said slot, said first and second inclined surfaces forming a recess adapted to receive a portion of the implement.

23. The sharpening apparatus of claim 21 wherein said bottom wall of said slot is disposed at an angle relative to said surface of said sharpening member.

24. The sharpening apparatus of claim 21 including a fastener for removably connecting said guide member to said base member.

* * * * *